US007673661B2

(12) United States Patent
Chase et al.

(10) Patent No.: US 7,673,661 B2
(45) Date of Patent: Mar. 9, 2010

(54) SENSOR SYSTEM FOR A REFRIGERATOR DISPENSER

(75) Inventors: Kevin M. Chase, St. Joseph, MI (US); Randell L. Jeffery, Stevensville, MI (US); Matthew J. Nibbelink, St. Joseph, MI (US); Brian Wendling, Sterling Heights, MI (US); Rahul Mehta, Antioch, TN (US); Vashishtha Kadchhud, Nashville, TN (US); Greg Hatch, Roselle, IL (US); Morounkeji Fatunde, East Lansing, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/103,170

(22) Filed: Apr. 15, 2008

(65) Prior Publication Data

US 2008/0264092 A1 Oct. 30, 2008

Related U.S. Application Data

(60) Provisional application No. 60/914,462, filed on Apr. 27, 2007.

(51) Int. Cl.
*B65B 1/04* (2006.01)

(52) U.S. Cl. ..... 141/360; 141/94; 250/221

(58) Field of Classification Search ..... 141/83, 141/94–96, 192, 198, 351, 360; 73/290 R; 62/389; 250/221
See application file for complete search history.

(56) References Cited

U.S. PATENT DOCUMENTS 3,823,846 A 7/1974 Probst
4,099,167 A 7/1978 Pomerantz et al.
4,121,433 A 10/1978 Pomerantz
4,202,387 A 5/1980 Upton
4,254,896 A 3/1981 Stanford et al.
4,257,237 A 3/1981 Hoenisch
4,266,144 A 5/1981 Bristol
4,282,430 A * 8/1981 Hatten et al. ..... 250/221
4,295,370 A 10/1981 Bristol
4,437,497 A 3/1984 Enander
4,437,499 A 3/1984 Devale
4,440,200 A 4/1984 DeVale et al.
4,446,896 A 5/1984 Campagna
4,458,735 A 7/1984 Houman (Continued)

FOREIGN PATENT DOCUMENTS

DE 19949612 A1 6/2001

(Continued)

*Primary Examiner*—Gregory L Huson
*Assistant Examiner*—Jason K Niesz
(74) *Attorney, Agent, or Firm*—Kirk W. Goodwin; Diederiks & Whitelaw PLC

(57) ABSTRACT

A sensing system for a refrigerator dispensing system is used to sense the presence, positioning, height and shape of a container placed in a dispensing well. When the presence of the container is sensed in the dispensing well and the container is properly positioned relative to a dispensing nozzle of the well, a dispensing operation can be performed. The actual dispensing operation is regulated based on the height and shape of the container. In this manner, dispensing operations can only be performed when a container is appropriately arranged in the dispensing well and the dispensing operation will be timely terminated based the size and shape of particular container employed.

24 Claims, 3 Drawing Sheets

U.S. PATENT DOCUMENTS

| | | | |
|---|---|---|---|
| 4,559,979 | A | 12/1985 | Koblasz et al. |
| 4,564,882 | A | 1/1986 | Baxter et al. |
| 4,572,253 | A | 2/1986 | Farmer et al. |
| 4,733,381 | A | 3/1988 | Farmer et al. |
| 4,780,861 | A | 10/1988 | Stembridge et al. |
| 4,798,232 | A | 1/1989 | Stembridge et al. |
| 4,817,689 | A | 4/1989 | Stembridge et al. |
| 4,883,100 | A | 11/1989 | Stembridge et al. |
| 4,890,651 | A | 1/1990 | Stembridge et al. |
| 4,917,155 | A | 4/1990 | Koblasz et al. |
| 4,944,335 | A | 7/1990 | Stembridge et al. |
| 4,961,456 | A | 10/1990 | Stembridge et al. |
| RE33,435 | E | 11/1990 | Koblasz et al. |
| 4,994,336 | A | 2/1991 | Benecke et al. |
| 5,017,909 | A | 5/1991 | Goekler |
| 5,036,892 | A | 8/1991 | Stembridge et al. |
| 5,165,255 | A | 11/1992 | Alvarez et al. |
| 5,406,843 | A | 4/1995 | Hannan et al. |
| 5,460,007 | A | 10/1995 | Reed et al. |
| 5,491,333 | A | 2/1996 | Skell et al. |
| 5,491,423 | A | 2/1996 | Turetta |
| 5,550,369 | A | 8/1996 | Skell et al. |
| 5,551,598 | A | 9/1996 | Cutsinger |
| 5,573,041 | A | 11/1996 | Skell et al. |
| 5,744,793 | A | 4/1998 | Skell et al. |
| 5,819,547 | A | 10/1998 | Oh |
| 5,862,844 | A | 1/1999 | Perrin |
| 5,895,910 | A | 4/1999 | Christian |
| 5,902,998 | A | 5/1999 | Olson et al. |
| 6,046,447 | A | 4/2000 | Skell et al. |
| 6,082,419 | A | 7/2000 | Skell et al. |
| 6,100,518 | A | 8/2000 | Miller |
| 6,227,265 | B1 | 5/2001 | Skell et al. |
| 6,265,709 | B1 | 7/2001 | Olson et al. |
| 6,337,959 | B1 | 1/2002 | Kwak et al. |
| 6,394,153 | B2 | 5/2002 | Skell et al. |
| 6,414,603 | B1 | 7/2002 | Yamaguchi et al. |
| 6,528,781 | B1 | 3/2003 | Olson et al. |
| 6,539,797 | B2 | 4/2003 | Livingston et al. |
| 6,546,741 | B2 | 4/2003 | Yun et al. |
| 6,681,585 | B1 | 1/2004 | Stagg et al. |
| 6,688,134 | B2 | 2/2004 | Barton et al. |
| 6,705,356 | B2 | 3/2004 | Barton et al. |
| 6,742,387 | B2 | 6/2004 | Hamamoto et al. |
| 6,761,284 | B2 | 7/2004 | Knepler |
| 6,766,687 | B2 | 7/2004 | Florenz et al. |
| 6,789,585 | B1 | 9/2004 | Janke |
| 6,823,730 | B2 | 11/2004 | Buck et al. |
| 6,840,100 | B1 | 1/2005 | Wotiz |
| 6,912,870 | B2 | 7/2005 | Gnadinger |
| 6,988,405 | B2 | 1/2006 | Jakoby et al. |
| 7,028,725 | B2 | 4/2006 | Hooker |
| 7,109,512 | B2 | 9/2006 | Wirthlin |
| 2004/0226962 | A1 | 11/2004 | Mazursky et al. |
| 2005/0103799 | A1 | 5/2005 | Litterst et al. |
| 2005/0138951 | A1 | 6/2005 | Hooker |
| 2005/0178273 | A1 | 8/2005 | Meuleners et al. |
| 2005/0268624 | A1 | 12/2005 | Voglewede et al. |
| 2005/0268639 | A1 | 12/2005 | Hortin et al. |
| 2006/0196212 | A1 | 9/2006 | Jenkins, Jr. et al. |
| 2007/0009365 | A1 | 1/2007 | Litterst et al. |

FOREIGN PATENT DOCUMENTS

| | | | |
|---|---|---|---|
| EP | 0644386 | A1 | 3/1995 |
| EP | 1521066 | A1 | 9/2004 |
| JP | 07-067892 | A | 3/1995 |
| JP | 2002-100976 | A | 4/2002 |
| JP | 2005-263278 | A | 9/2005 |

* cited by examiner

SENSOR SYSTEM FOR A REFRIGERATOR DISPENSER

CROSS-REFERENCE TO RELATED APPLICATIONS

The present application claims the benefit of U.S. Provisional Patent Application Ser. No. 60/914,462 filed Apr. 27, 2007 entitled "Sensor System for a Refrigerator Dispenser."

BACKGROUND OF THE INVENTION

1. Field of the Invention

The present invention pertains to the art of refrigerators and, more particularly, to a sensor system for a refrigerator dispenser that determines both the size and shape of a container.

2. Description of the Related Art

Refrigerators having built-in ice/water dispensers are well known in the art. In general, the dispensers are mounted to a door of the refrigerator for the purpose of dispensing a water-based material, i.e., ice and/or water, without requiring a user to access a refrigerator compartment. A typical dispenser includes a dispenser well into which a container is placed. Once the container is in position, an actuator is operated to release the ice and/or water into the container.

In many cases, the actuator is a pressure sensitive mechanical switch. Typically, the switch is operated by pushing the container against, for example, a lever. The lever, in turn, operates the switch that causes the ice and/or water to be dispensed. A number of dispensers employ multiple actuators, one for ice and another for water, while other dispensers employ a single actuator. Dispensers which employ a single actuator typically require additional control elements that enable a user to select between ice and water dispensing operations. Several manufacturers have converted from mechanical switches to electrical or membrane switches. Functioning in a similar manner, a container is pushed against the membrane switch to initiate the dispensing operation. Still other arrangements employ actuator buttons provided on a control panel of the dispenser. With this type of arrangement, the user continuously depresses a button to release ice and/or water into the container.

Over time, mechanical and membrane switches can wear out. Physical interaction with the switches results in wear and tear on contact points, springs, levers and the like which eventually require replacement. In addition, most existing systems lack an automatic cut-off feature. More specifically, once activated, the dispenser will discharge water or ice until the pressure is removed from the actuator. If the user is momentarily distracted, or if the dispenser is operated by an inexperienced individual such as a child, ice and/or water can overflow the container. In order to address this concern, manufacturers have developed automatic cut off features for dispensers. However, existing automatic cut-off controls, many of which are based solely on container height, are not overly effective. If a container is not properly located within the dispenser well, either too little or too much water/ice will be dispensed. In addition, existing systems are not able to account for various container shapes, such as water bottles, coffee pots and the like. Differences in container shape affect where an outlet of the dispenser is positioned relative to an opening of the container.

Therefore, despite the existence of refrigerator dispensers in the prior art, there exists a need for an enhanced refrigerator dispensing system. More specifically, there exists a need for a refrigerator dispensing system that employs a sensor system that detects both size and shape of a container and initiates a dispensing operation based on the particular container size and shape.

SUMMARY OF THE INVENTION

The present invention is directed to a sensor system for a refrigerator dispenser. The sensing system is arranged in the dispenser area and configured to detect a height of a container positioned to receive ice and/or water. In accordance with the invention, container height is determined by locating an upper rim portion of the container. After detecting the upper rim portion, a dispensing operation is initiated. At this point, a user can either remove the container at a desired fill level or allow the filling to automatically stop when the water and/or ice level approaches the upper rim portion.

In addition to detecting container size, the sensing system determines other characteristics of the container, specifically the shape, including the width, of the container. More specifically, by evaluating shape characteristics of the container, the sensing system can determine both an approximate location of an opening in the container and size characteristics of the container. In connection with the location aspect, the sensor system can ensure that the opening of the container and the dispenser nozzle are properly aligned. If the opening is not properly positioned, the dispensing operation is paused until the container is adjusted. In addition, size characteristics are employed in connection with properly filling of the container.

In accordance with certain aspects of the invention, the sensing system employs infrared sensors to determine container height and shape. In accordance with another aspect of the invention, the sensing system employs ultrasonic sensors to determine container height and shape. In accordance with yet another aspect of the invention, the sensing system employs photoelectric sensors which may be rotated to determine container height and shape. In accordance with still another aspect of the invention, the sensing system employs a digital imaging system utilizing CCD or CMOS cameras to determine container height and shape.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
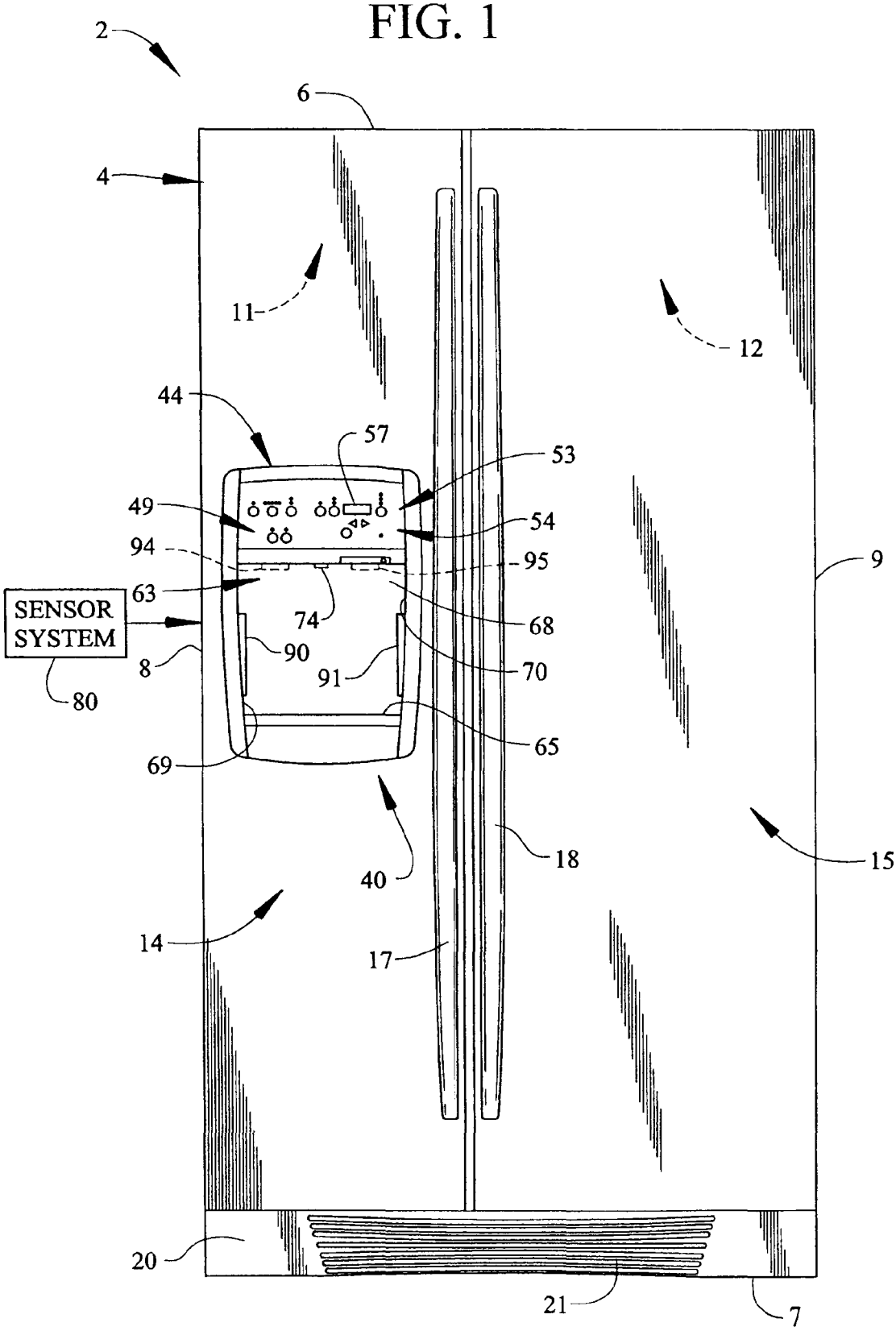
FIG. 1 is a front elevational view of a refrigerator incorporating a dispenser having a sensor system constructed in accordance with the present invention.
Figure 2:
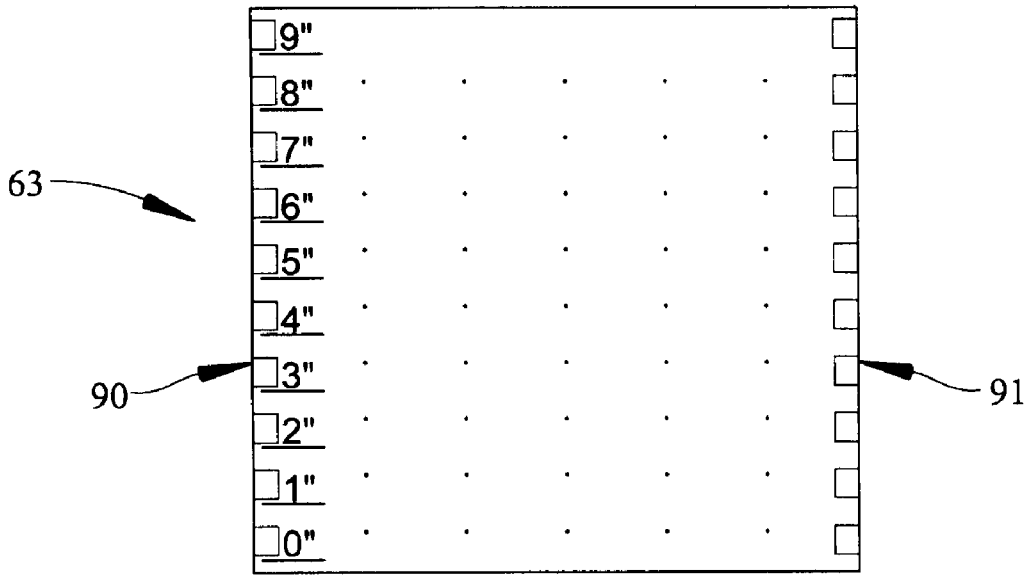
FIG. 2 is a schematic representation of a sensor system employing transmissive infrared (IR) arrays positioned to determine container height and shape constructed in accordance with a first embodiment of the present invention.

With initial reference to FIG. 1, a refrigerator constructed in accordance with the present invention is generally indicated at 2. Refrigerator 2 includes a cabinet 4 having a top wall 6, a bottom wall 7 and opposing side walls 8 and 9. In a manner known in the art, refrigerator 2 includes a freezer compartment 11 arranged along side a fresh food compartment 12. Freezer compartment 11 includes a corresponding freezer compartment door 14 and fresh food compartment 12 includes a corresponding fresh food compartment door 15. In a manner also known in the art, each door 14, 15 includes an associated handle 17, 18. Refrigerator 2 is also shown to include a kick plate 20 arranged at a bottom portion thereof having a vent 21 that permits air to flow into refrigeration components (not shown) that establish and maintain desired temperatures in freezer compartment 11 and fresh food compartment 12. In the embodiment shown, refrigerator 2 constitutes a side-by-side model. However, it should be understood that the present invention could also be employed in connection with a wide variety of refrigerators, including top mount, bottom mount, and French-style refrigerator models.

In accordance with the invention, refrigerator 2 includes a dispenser assembly 40 having a main housing 44 and a control panel 49. Control panel 49 includes first and second rows of control buttons 53 and 54 which enable a user to select a preferred dispensing operation. Control panel 49 further includes a display 57 which, in addition to functioning in cooperation with dispenser assembly 40, enables the user to select particular operational parameters for refrigerator 2 such as, desired temperatures for freezer compartment 11 and fresh food compartment 12.

Dispenser assembly 40 includes a dispenser well 63 having a base or container support portion 65, a recessed, upstanding wall section 68 and a pair of opposing side walls 69 and 70. A nozzle or spigot 74 is arranged in an upper portion (not separately labeled) of dispenser well 63 and aimed to deliver a flow of water downward into a container 77 (see FIGS. 3-6) placed in dispenser well 63. An ice outlet (not shown) is also provided in an upper portion of dispenser well 63 for dispensing ice. At this point, it should be realized that dispenser well 63 can be provided with laterally spaced container receiving zones for ice and water respectively or a common receiving zone as depicted. More importantly, in accordance with the invention, dispenser assembly 40 includes a sensor system 80 that detects both the size and shape of a container placed within dispenser well 63. As will be detailed more fully below, sensor system 80 employs at least one sensor 90 positioned in dispenser well 63.

In accordance with one embodiment of the invention, sensor system 80 employs a pair of sensor arrays 90 and 91 arranged on opposing side walls 69 and 70 respectively of dispenser well 63. Sensors 90 and 91 are constituted by arrays of transmissive infrared sensors having aligned and paired emitter and detector components as shown. The infrared sensors 90, 91 provide a "zero" or "low" output if an object is not detected and a "one" or "high" output if an object is detected. The output would be the same for every sensor in the array. In a preferred embodiment, the highest sensor having a "high" output establishes the minimum height of the object, while the lowest sensor having a "low" output would establish the maximum height of the object.

Figure 3:
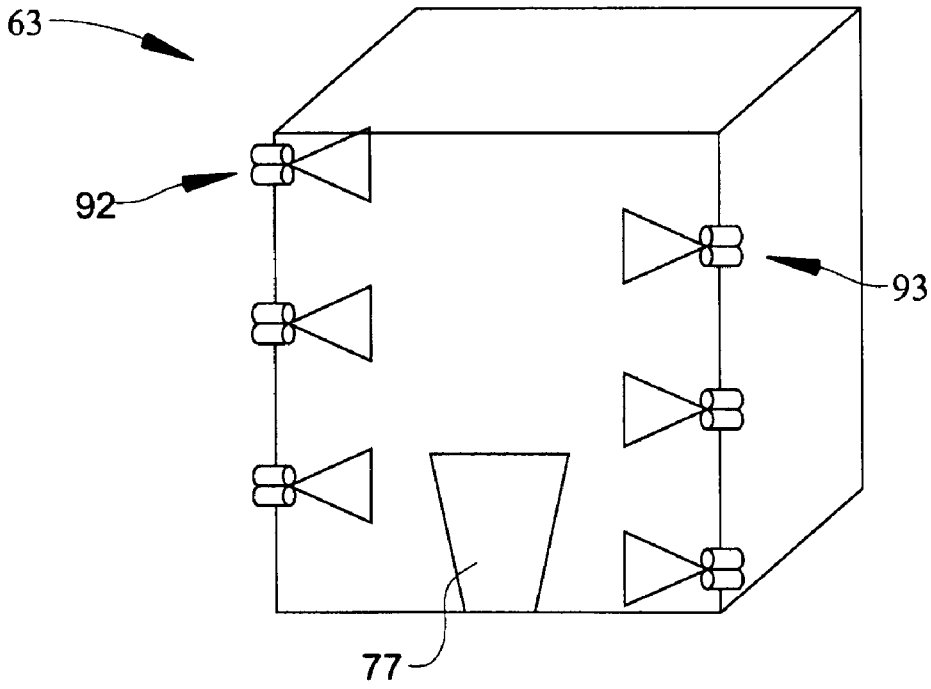
FIG. 3 is a schematic view of the sensing system utilizing retro-reflective IR sensors to detect container height and shape constructed in accordance with a second embodiment the present invention.

In addition to sensing height, the transmissive arrays of infrared sensors can be arranged to sense container shape, including container width. For this purpose, the various pairs of sensors 90, 91 are preferably part of an overall array or matrix arranged along opposing side walls 69 and 70, with the matrix having height and depth dimensions to enable the container height and shape to be sensed. In another form of the invention as shown in FIG. 3, retro-reflective IR sensors 92 and 93 are employed for corresponding reasons, with sensors 92 and 93 being placed off-set or angled relative to one another and at predetermined number of increments in a vertical direction on opposing side walls 69 and 70 of dispenser well 63 as shown. In particular, in the exemplary embodiment shown, note the left side pairs of sensors 92 are vertically offset from the right side pairs of sensors 93. In addition, the pairs of sensors 92, 93 can be angled relative to each other. This allows detection of both the height of the container in manner similar to that described above but, through processing of analogous data, also detects variations in the width or shape of the container. In particular, the output enables sensor system 80 to estimate a distance of the container from each sensor. With this information, it is possible to estimate the width of the container and also where the container is placed in dispenser well 63 in order to ensure proper alignment with spigot 74. In each of these cases, readings taken from the sensors can be utilized to determine a shape of the container and at what height the maximum and minimum dimensions of the container occur.

Figure 4:
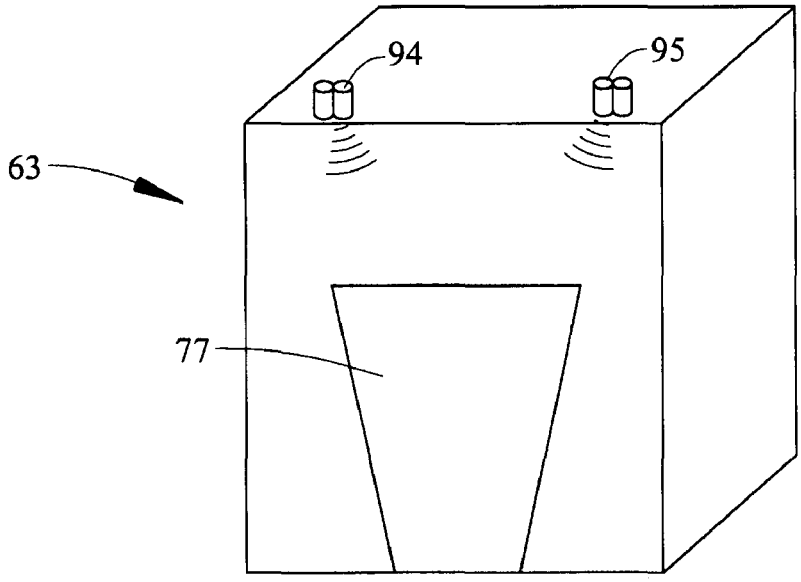
FIG. 4 is a block diagram illustrating a third embodiment of the present invention in which ultrasonic sensors are utilized to detect container height and a change in height of contents of the container being filling by the dispenser in accordance with the present invention.

In accordance with another embodiment of the invention illustrated in FIG. 4, sensor system 80 employs ultrasonic sensors 94 and 95 to determine container height. Ultrasonic sensors 94 and 95 are shown mounted on an upper portion of dispenser well 63. Sensors 94 and 95 can determine the positioning of container 77 in dispenser well 63. The sensors 94, 95 are aimed downward and receive signals reflected back from the rim and body of the container 77. The reflected signals signify the distance to the rim thereby determining a height of the container. Of course, ultrasonic sensors 94 and 95 could also be utilized to monitor changes in fill level of the container 77. Although shown with sensors 94 and 95 being arranged in an exemplary fashion, the actual number, relative positioning and angling of multiple ultrasonic sensors can be varied to enhance both height and shape determinations to be readily made.

Figure 5:
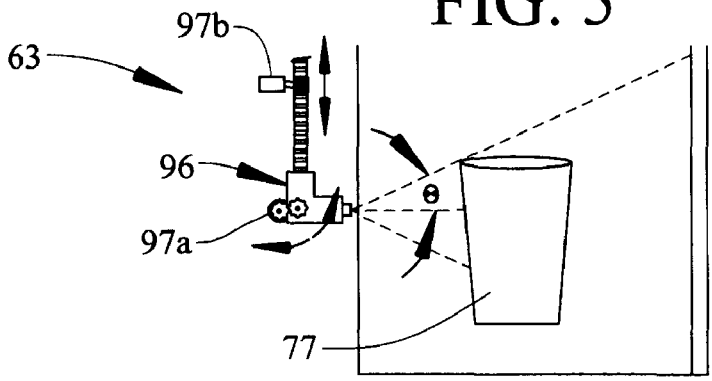
FIG. 5 is a diagram illustrating a fourth embodiment of the present invention in which a photoelectric device is utilized to determine container height and shape.

In accordance with yet another embodiment of the present invention, sensor 90 is constituted by a photoelectric sensor 96 such as shown in FIG. 5. Photoelectric sensors utilize co-located emitters and receivers (usually diodes) to detect the presence, absence or distance of a target object. Proximity photoelectric sensors have an emitter and a detector co-located in a single housing and rely upon reflection from a surface of a target to determine whether an object is present. Also, specialized, clear object, photoelectric sensors can detect clear containers, as well as solid containers. Each of these types of photoelectric sensors can be employed in accordance with the invention. In any case, light sent from an emitter hits the container and is reflected back to sensor 96. By evaluating changes in the light, photoelectric sensor 96 determines when the container is present, as well as to determine the position, size (height) and shape of the container. Actually, depending on the intensity of the reflected light, the material composition of the container can also be established. In a preferred embodiment, photoelectric sensor 96 is rotated by an electric motor 97*a* along a horizontal axis in order to scan dispenser well 63 in connection with determining container height. In addition, photoelectric sensor 96 could be driven vertically by a small motor 97*b* (such as a servo) to scan the container for height, shape and other parameters. Certainly, the rotation and vertical shifting motions can be performed in a wide variety of ways. Alternatively, several photoelectric sensors can be mounted within dispenser well 63 to determine the size and shape of the container. That is, with only one or more sensors on one side, an assumption is made that the container is symmetrically constructed. However, further container specifics can be assured by just employing multiple sensors on opposing sides of the container.

Figure 6:
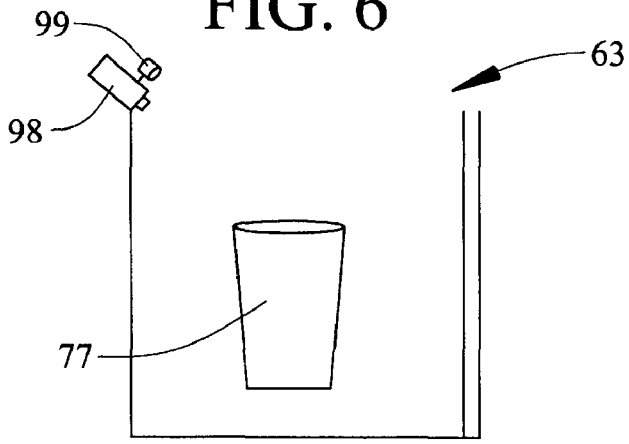
FIG. 6 is a diagram illustrating a fifth embodiment of the present invention wherein digital imaging is utilized to determine container height and shape.

In accordance with yet another aspect of the present invention as shown in FIG. 6, sensor system 80 employs one or more digital image captive devices 98, such as CCD or CMOS cameras, to capture an image of the container. Although not shown, each camera 98 is linked to a controller of sensor system 80 which performs algorithmic processing of the data. A light source 99 (either IR or visible) is utilized to illuminate the container, allowing camera 98 to accurately detect the rim, while enabling the diameter, height and other shape parameters of the container to be estimated, including container material. The camera 98 is preferably mounted in an uppermost portion of dispenser well 63 and focused downward at both ice and water dispensing areas. Alternatively, multiple cameras could be utilized, such as one for ice and one for water dispensing.

Although described with reference to preferred embodiments of the invention, it should be readily understood that various changes and/or modifications can be made to the invention without departing from the spirit thereof. In general, it should be readily apparent that the present invention employs a sensing system which can advantageous sense at least each of the presence, positioning, height and shape of a container placed in a dispensing well of a refrigerator. Additionally, a fill level of the container and even the material of the container can actually be sensed. A dispensing operation can be automatically performed when the presence of the container is sensed in the dispensing well and the container is properly positioned relative to a dispensing nozzle of the well. In addition, the actual dispensing operation is controlled or regulated based on the height and shape of the container. In this manner, dispensing operations can only be performed when a container is appropriately arranged in the dispensing well and the dispensing operation will be timely terminated based on the size and shape of the particular container employed. In any case, the invention is only intended to be limited by the scope of the following claims.

What is claimed is:

1. A refrigerator comprising:

a cabinet;

at least one refrigerated compartment arranged within the cabinet;

a door mounted to the cabinet for selectively providing access to the at least one refrigerated compartment; and a dispenser assembly provided in the door for selectively releasing at least one of water and ice to a consumer, said dispenser assembly including:

a main housing;

a dispenser well provided in the main housing, said dispenser well including an upper portion, a base section for supporting a container, a recessed upstanding wall section and opposing side wall sections;

a dispensing outlet arranged in the upper portion of the dispenser well for delivering a container filling towards the base section; and a sensor system including at least one sensor exposed to the dispenser well, said at least one sensor being configured to detect each of a presence, positioning, height and shape of a container placed in the dispensing well.

2. The refrigerator according to claim 1, wherein the at least one sensor is constituted by a plurality of infrared sensors mounted along the opposing side wall sections of the dispensing well.

3. The refrigerator according to claim 2, wherein the plurality of infrared sensors constitutes an array of spaced, paired infrared sensors mounted along the opposing side wail sections.

4. The refrigerator according to claim 1, wherein the at least one sensor constitutes a retro-reflective infrared sensor.

5. The refrigerator according to claim 4, wherein the at least one sensor constitutes multiple retro-reflective sensors mounted, in a vertically offset configuration, along opposite wall sections of the dispensing well.

6. The refrigerator according to claim 1, wherein the at least one sensor is constituted by a plurality of ultrasonic sensors exposed to the dispensing well.

7. The refrigerator according to claim 6, wherein the plurality of ultrasonic sensors are mounted along the upper portion of the dispensing well.

8. The refrigerator according to claim 1, wherein the at least one sensor is constituted by at least one photoelectric sensor exposed to the dispensing well.

9. The refrigerator according to claim 8, wherein the at least one photoelectric sensor is rotatable by a motor relative to the main housing for scanning the dispensing well.

10. The refrigerator according to claim 9, wherein the at least one photoelectric sensor is rotatable by a motor about a substantially horizontal axis.

11. The refrigerator according to claim 9, wherein the at least one photoelectric sensor is vertically shiftable relative to the main housing for scanning the dispensing well.

12. The refrigerator according to claim 8, wherein the at least one photoelectric sensor is employed to determine a material composition of the container.

13. The refrigerator according to claim 1, wherein the at least one sensor is constituted by a digital image captive device exposed to the dispensing well, wherein the digital image captive device is a digital camera.

14. The refrigerator according to claim 13, wherein the digital image captive device includes a light source for illuminating the container for imaging purposes.

15. The refrigerator according to claim 13, wherein the digital image capture device is also employed to determine a material of the container.

16. A method of dispensing a liquid from a refrigerator door mounted dispenser assembly including a dispensing well having a water-based dispensing outlet comprising:

sensing each of a presence, position, height and shape of a container placed in the dispensing well;

initiating a dispensing operation by introducing a water-based material into the container when the presence of the container is sensed in the dispenser well and the container is properly positioned relative to the nozzle; and regulating the dispensing operation based on the height and shape of the container.

17. The method of claim 16, wherein each of the presence, position, height and shape of the container is determined based on signals received from a plurality of infrared sensors constituted by a first array of vertically spaced infrared sensors mounted along one side wall section of the dispensing well and a second array of vertically spaced infrared sensors mounted along an opposing side wall section of the dispensing well, with the first and second arrays of vertically spaced infrared sensors being vertically offset relative to each other.

18. The method of claim 16, wherein each of the presence, position, height and shape of the container is determined based on signals received from a plurality of ultrasonic sensors mounted along an upper portion of and exposed to the dispensing well.

19. The method of claim 16, wherein each of the presence, position, height and shape of the container is determined based on signals received from at least one photoelectric sensor exposed to the dispensing well.

20. The method of claim 19, further comprising: rotating the at least one photoelectric sensor, through the use of a motor, to scan the dispensing well.

21. The method of claim 20, further comprising: vertically shifting the at least one photoelectric sensor to scan the dispensing well.

22. The method of claim 21, further comprising: using the at least one photoelectric sensor to determine a material composition of the container.

23. The method of claim 16, wherein each of the presence, position, height and shape of the container is determined based on signals received from a digital image captive device exposed to the dispensing well, wherein the digital image captive device is a digital camera.

24. The method of claim 23, further comprising: operating a light source of the digital image captive device to illuminate the container for imaging purposes.

* * * * *